US005672842A

United States Patent [19]

Brion et al.

[11] Patent Number: 5,672,842

[45] Date of Patent: Sep. 30, 1997

[54] CASE FOR PROPELLANT CHARGE

[75] Inventors: Bernard Brion; Michel Hossard, both of Bourges, France

[73] Assignee: Giat Industries, Versailles, France

[21] Appl. No.: 781,139

[22] Filed: Jan. 9, 1997

Related U.S. Application Data

[63] Continuation of Ser. No. 536,783, Sep. 29, 1995, abandoned.

[30] Foreign Application Priority Data

Oct. 6, 1994 [FR] France ..... 94 11937

[51] Int. Cl.[6] ..... F42B 5/00

[52] U.S. Cl. ..... 102/282; 102/431; 102/435; 102/700; 102/704

[58] Field of Search ..... 102/282, 289, 102/290, 331, 430–435, 442, 443, 530, 531, 700, 704

[56] References Cited

U.S. PATENT DOCUMENTS

| | | | |
|---|---|---|---|
| 1,187,779 | 6/1916 | Patten . | |
| 3,204,558 | 9/1965 | Jacobson et al. . | |
| 3,527,168 | 9/1970 | McCurdy et al. . | |
| 3,658,008 | 4/1972 | Larson | 102/431 |
| 3,734,020 | 5/1973 | Ciccone et al. . | |
| 4,098,193 | 7/1978 | Schroeder | 102/435 |
| 5,052,304 | 10/1991 | Rahnenfuhrer et al. | 102/435 |

FOREIGN PATENT DOCUMENTS

| | | |
|---|---|---|
| 0 304 100 | 2/1989 | European Pat. Off. . |
| 0 410 075 | 1/1991 | European Pat. Off. . |
| 0 475 207 | 3/1992 | European Pat. Off. . |
| 0 499 244 | 8/1992 | European Pat. Off. . |
| 437 228 | 4/1912 | France . |
| 692 609 | 11/1930 | France . |
| 35348 | 7/1885 | Germany . |

*Primary Examiner*—Harold J. Tudor
*Attorney, Agent, or Firm*—Oliff & Berridge

[57] ABSTRACT

A case for use with a propellant charge has a substantially cylindrical envelope. The envelope is formed from a combustible material. At least one support, that is formed from a combustible material, is coated to a substantially uniform thickness on at least one reception section with an anti-wear additive. A mechanism, formed from a combustible material, positions the support relative to the envelope such that, after assembly, at least one empty space is defined between an inner surface of the envelope and the anti-wear additive.

3 Claims, 8 Drawing Sheets

CASE FOR PROPELLANT CHARGE

Figure 1:
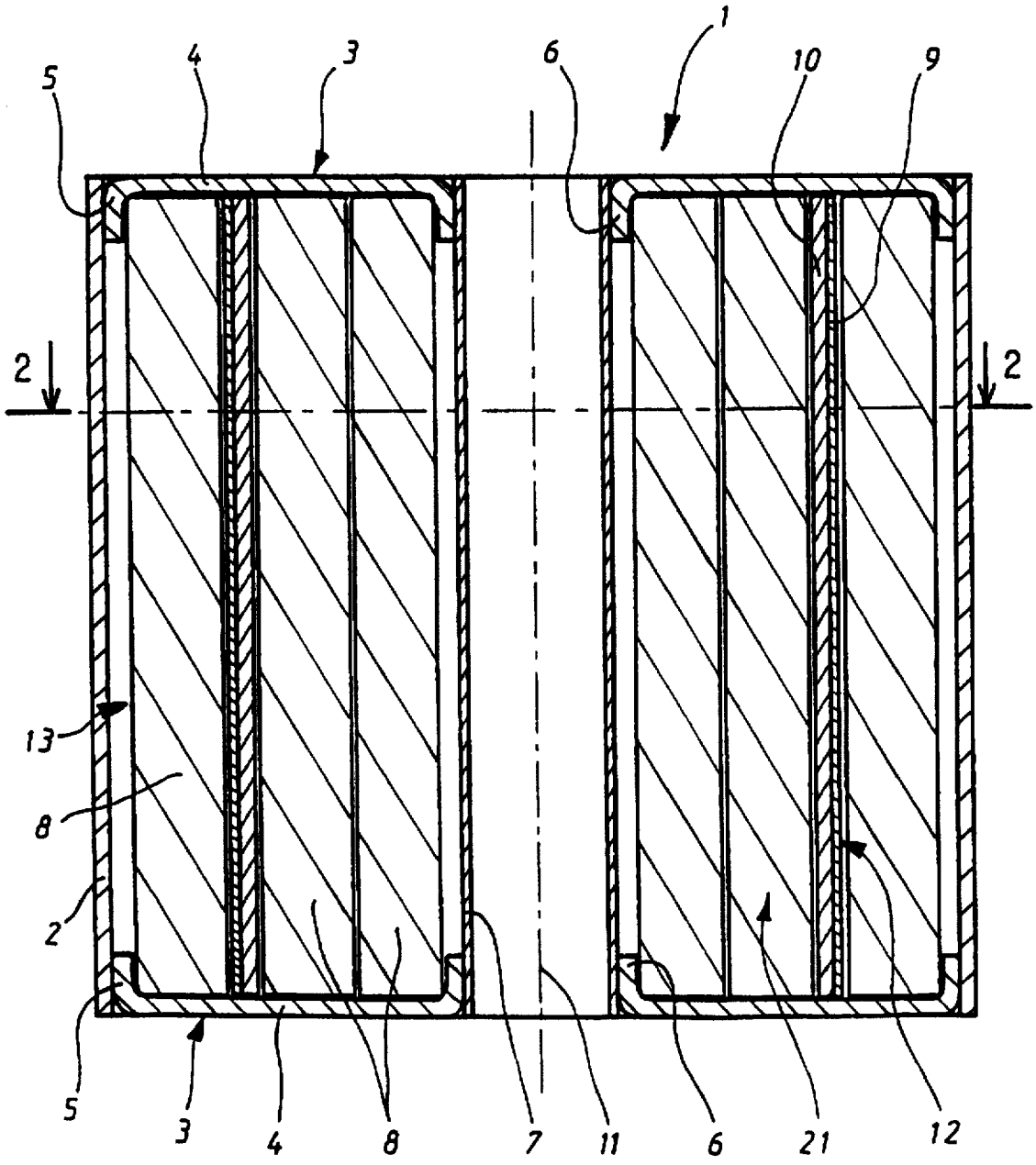

This is a continuation of application Ser. No. 08/536,783 filed on Sep. 29, 1995 now abandoned.

The technical scope of the invention is that of cases made of a combustible material designed to enclose a propellant charge in particular for large calibre artillery munitions.

Large calibre artillery munitions cause, during firing, a great deal of wear to the barrel of the weapon.

So as to reduce this amount of wear, it is known to provide anti-wear additives mixed with the propellant charge contained in the munition or deposited on the inner surface of the envelope containing the latter. Thus, patent EP0410075 provides for the depositing of a mixture of wax and titanium dioxide on the inner surface of the cylindrical envelope of a module or combustible shell.

Large calibre artillery munitions currently in service ever-increasingly use modular propellant charges which, by increasing or decreasing their number, enable the velocity of the projectile or the firing range to be adjusted.

But this in turn causes problems which are particularly apparent when there are few modules selected, about two modules, for example. In fact, as there is only a small quantity of propellant charge, the energy given off by the latter is not enough to totally burn the combustible envelope of the modules, the anti-wear additive layer deposited on the envelope providing a barrier preventing the transmission of combustive gases to the latter. A large quantity of non-burned residue remains as a result, which prejudices the smooth functioning of the weapon. The anti-wear additive may also be unevenly spread over the inner surface of the barrel, remaining in compact clumps, because it has not been sufficiently attacked by the combustive gases of the propellant charge. These clumps of additive also prejudice the smooth functioning of the weapon.

The aim of the invention is to propose a case made of combustible material which comprises an anti-wear additive and meets such disadvantages.

The case according to the invention thus ensures the total combustion of the material which makes up its envelope whilst evenly spreading the anti-wear additive. The barrels of weapons are thereby effectively protected, even when there is a small quantity of propellant charge.

The invention also allows the anti-wear additive to be put into place in a combustible case quickly and inexpensively.

The subject of the invention is thus a case for a propellant charge comprising a roughly cylindrical envelope made of a combustible material, characterised in that it comprises:

- firstly, at least one support also made of a combustible material and coated on at least one reception section by an anti-wear additive and,
- secondly, means to ensure the positioning of the support with respect to the envelope such that, after assembly, an empty space is left between the inner surface of the envelope and the anti-wear additive.

According to a first embodiment, the support is a sheet of a roughly cylindrical shape resting against at least one radial limit stop which ensures that an empty space is left between the inner surface of the envelope and the anti-wear additive.

According to a first alternative embodiment, the radial limit stop is formed of part of the propellant charge.

According to a second alternative embodiment, the radial limit stop is formed at least by a lid closing the top of the case.

The reception section or sections for the anti-wear additive may be formed of outward openings made on a cylindrical wall of the support, the opening or openings being partly filled by the anti-wear additive such that an empty space is arranged between the anti-wear additive and the inner surface of the envelope.

The cylindrical wall of the support may form an extension of at least one lid which closes the envelope.

According to another embodiment, the support is formed of a corrugated sheet, the reception section for the anti-wear additive being formed of at least one inner and/or outer hollow.

The reception section may be formed of at least one inner hollow, the outer hollows remaining empty.

The reception section may be formed of at least one outer hollow, the inner hollows remaining empty.

According to another characteristic, the corrugated sheet rests on the inner surface of the envelope.

Figure 2:
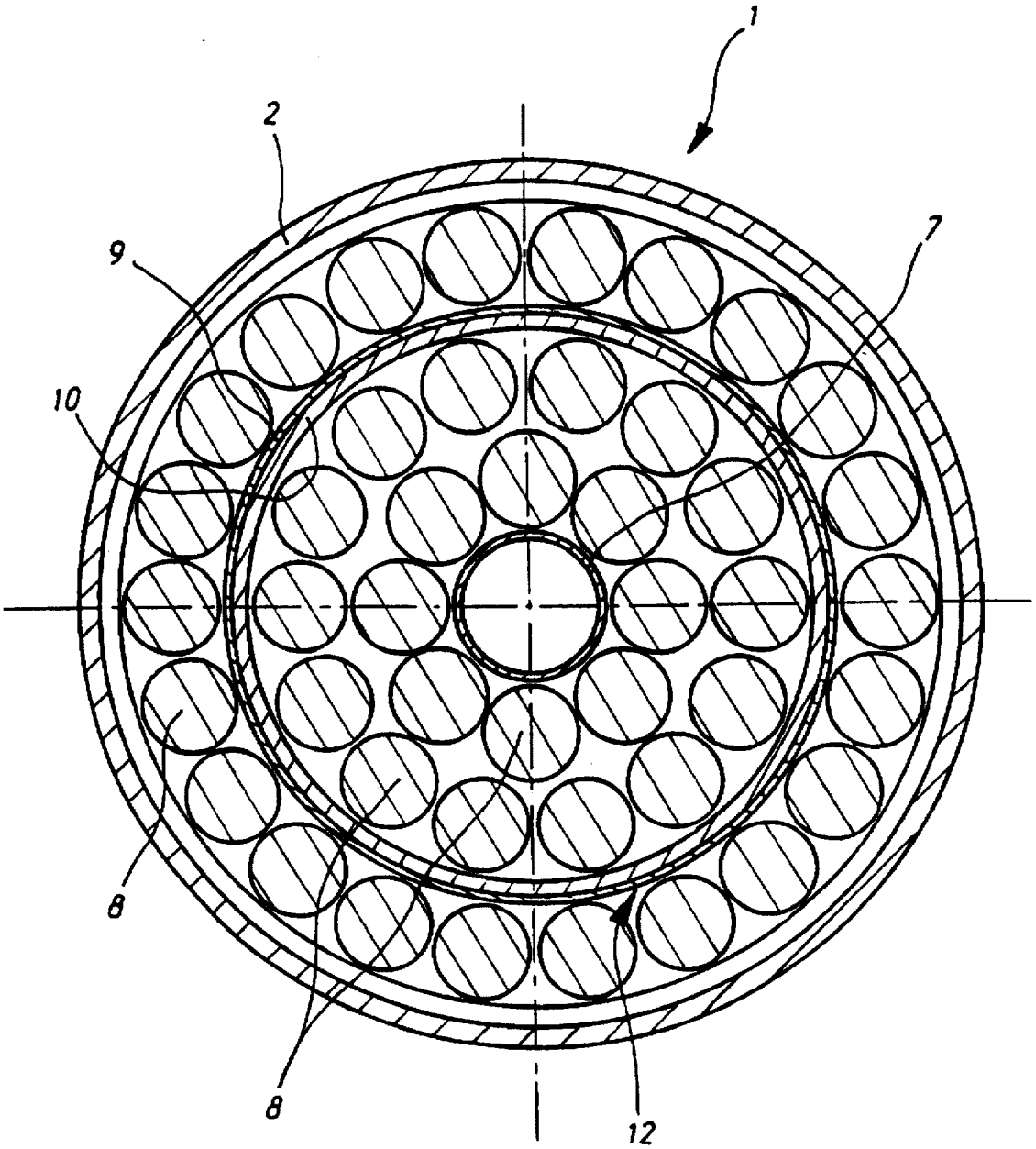
Figure 3:
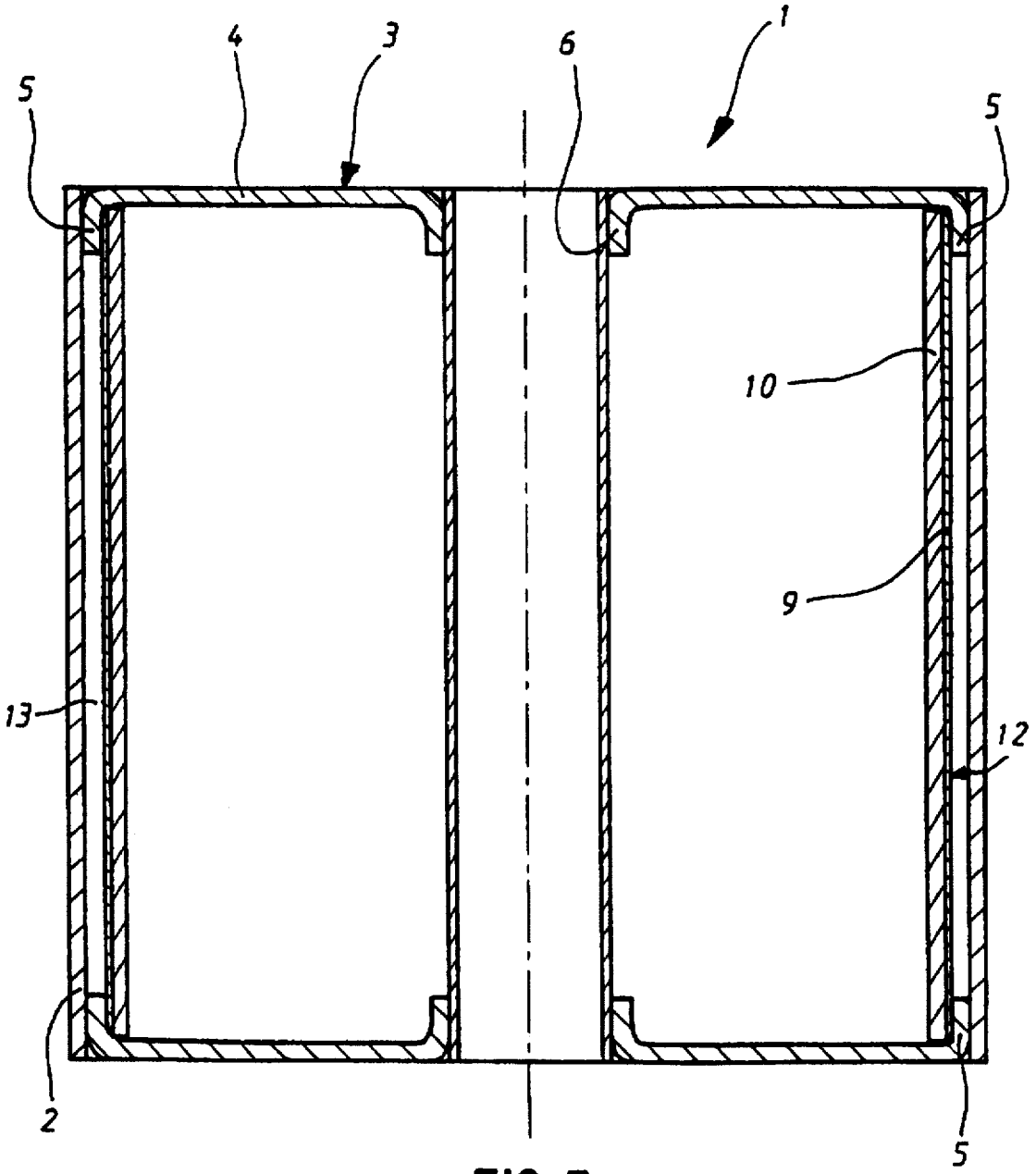
Figure 4:
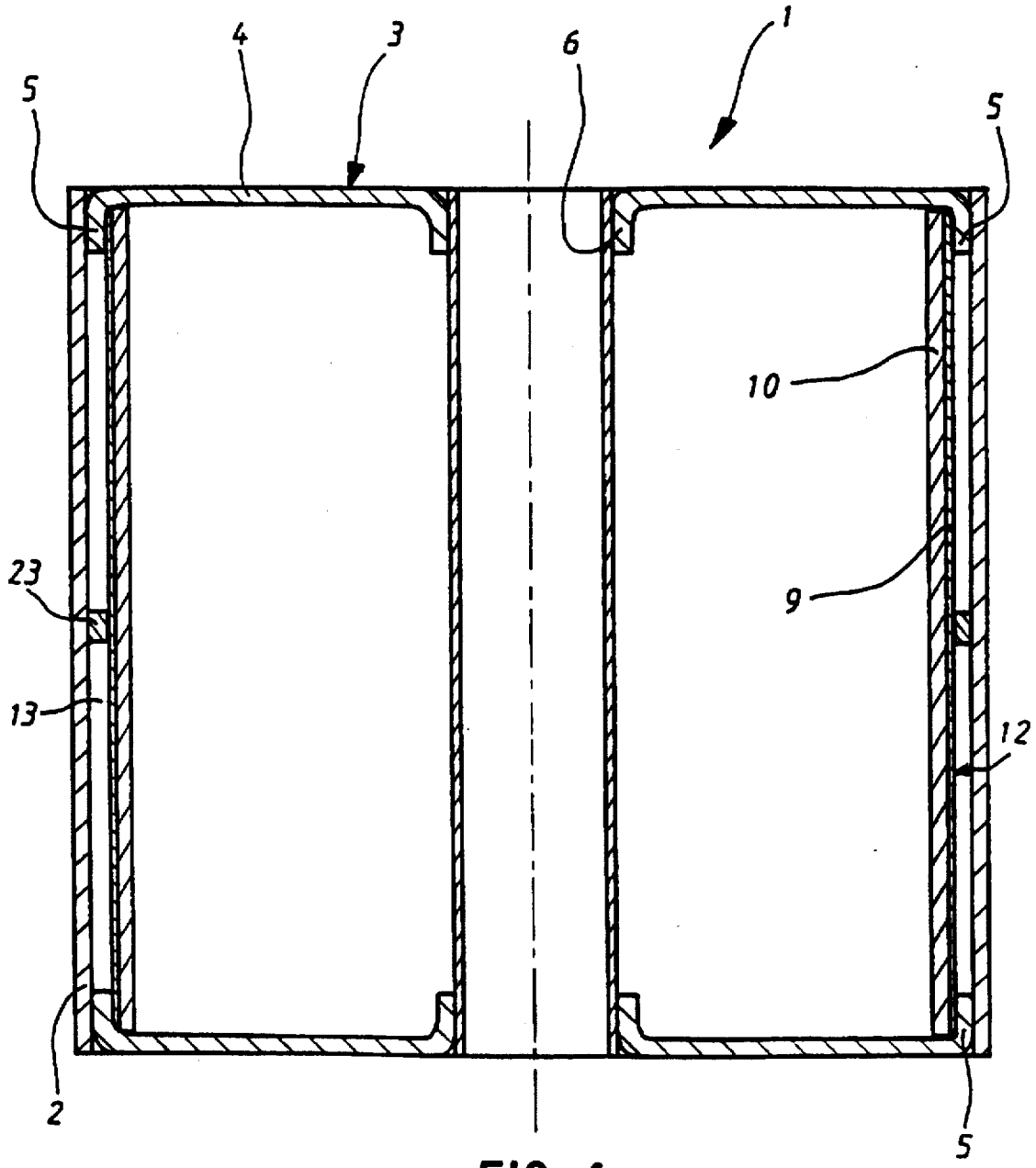
Figure 5:
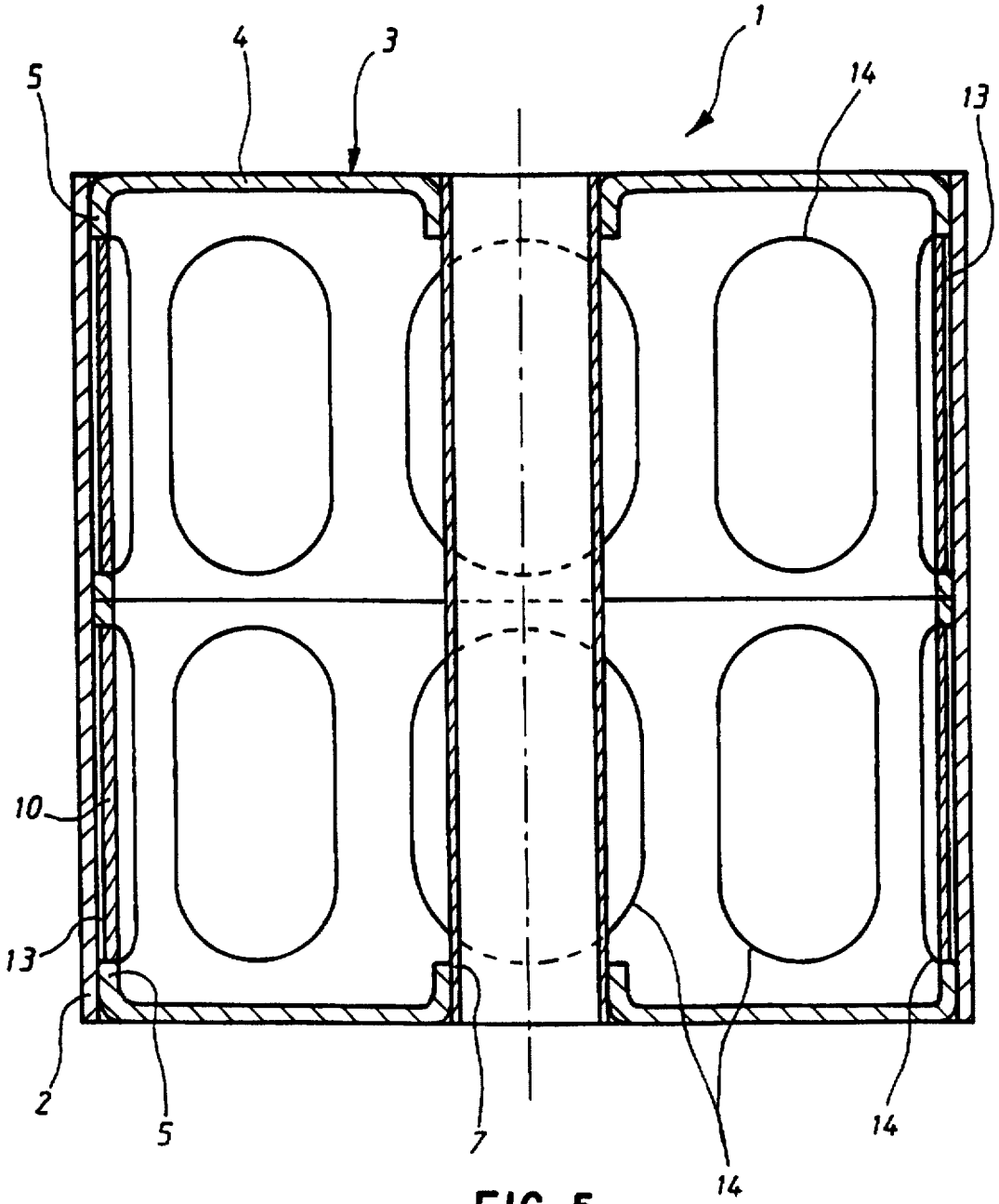
Figure 6:
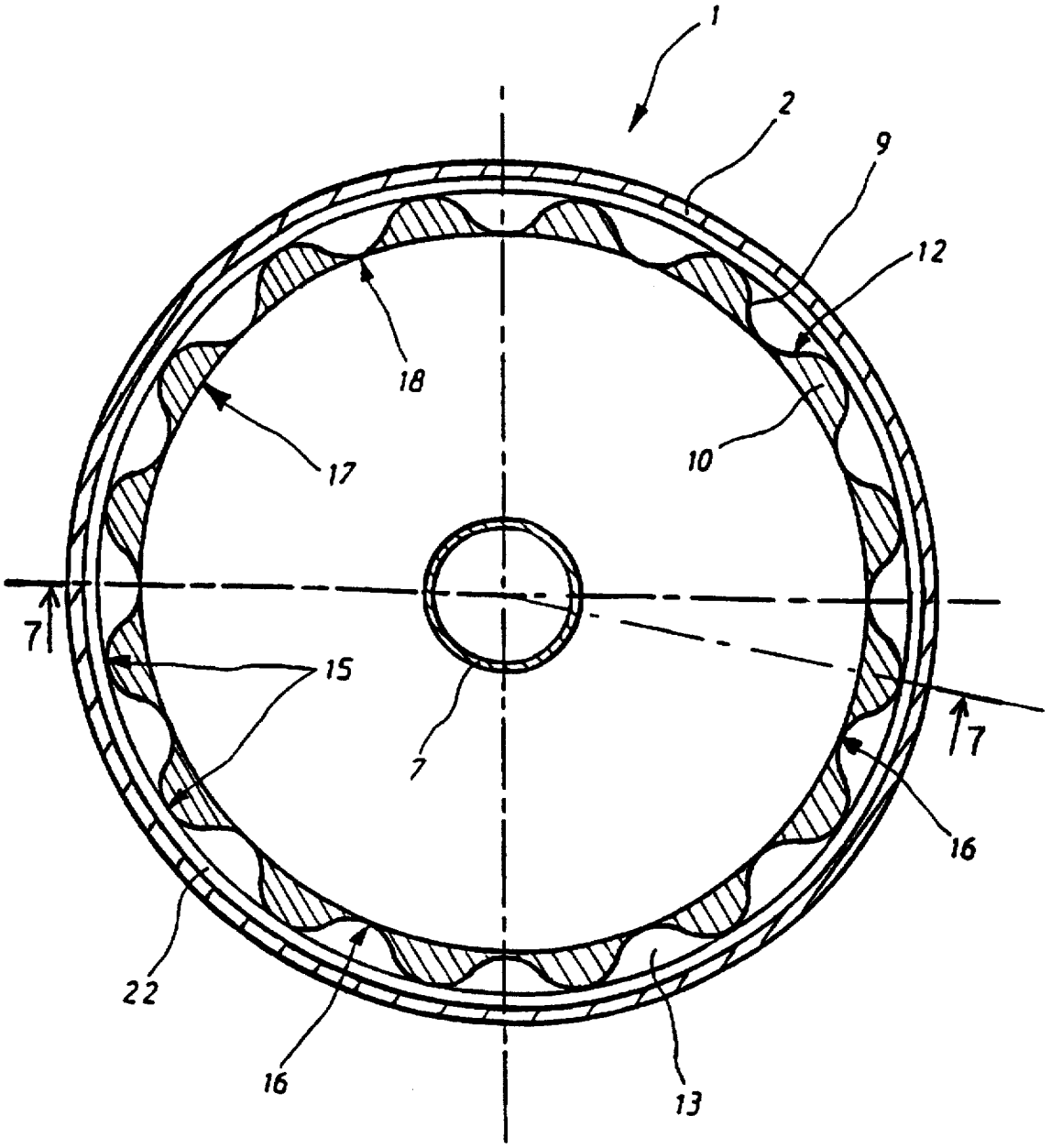
Figure 7:
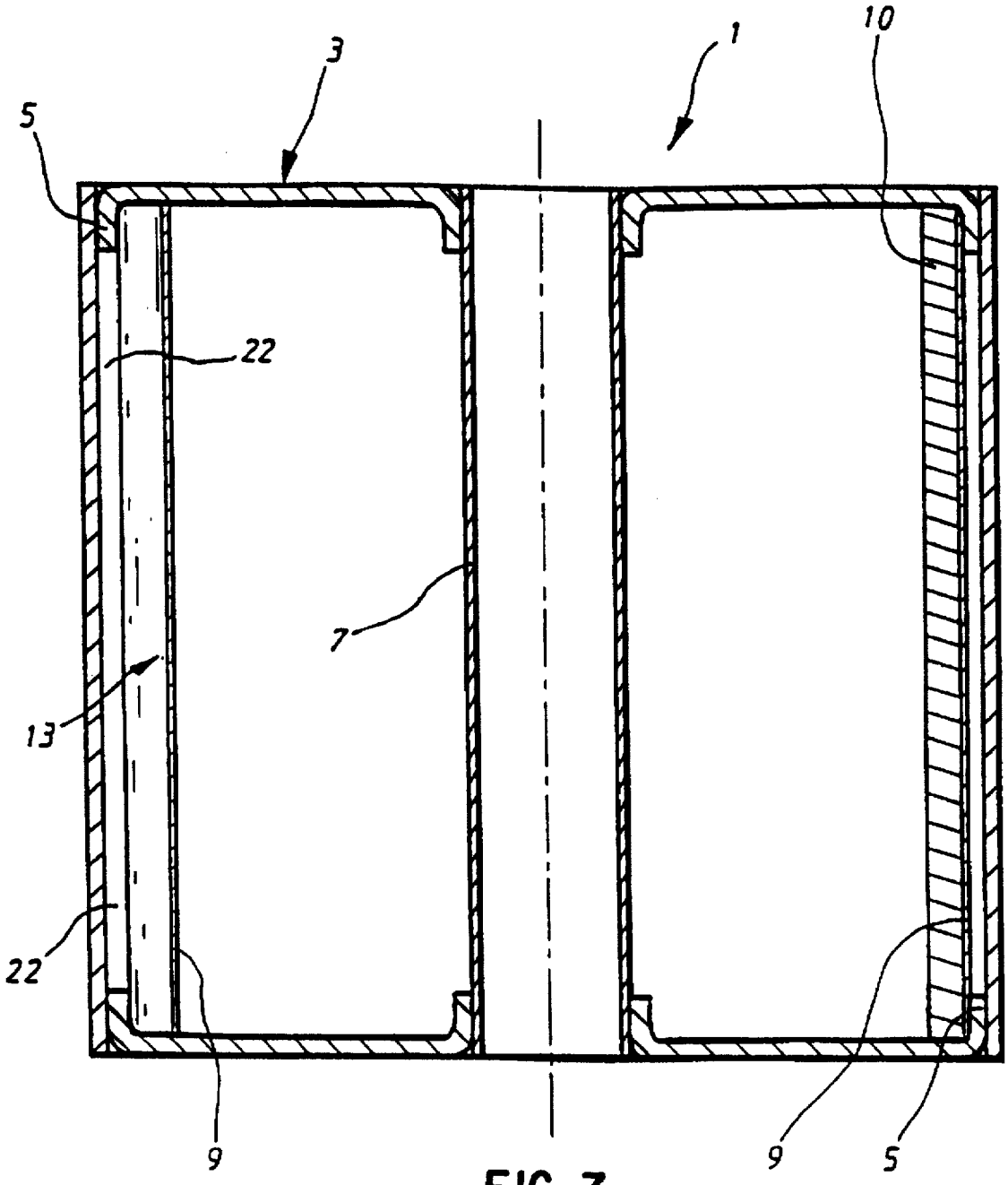
Figure 8:
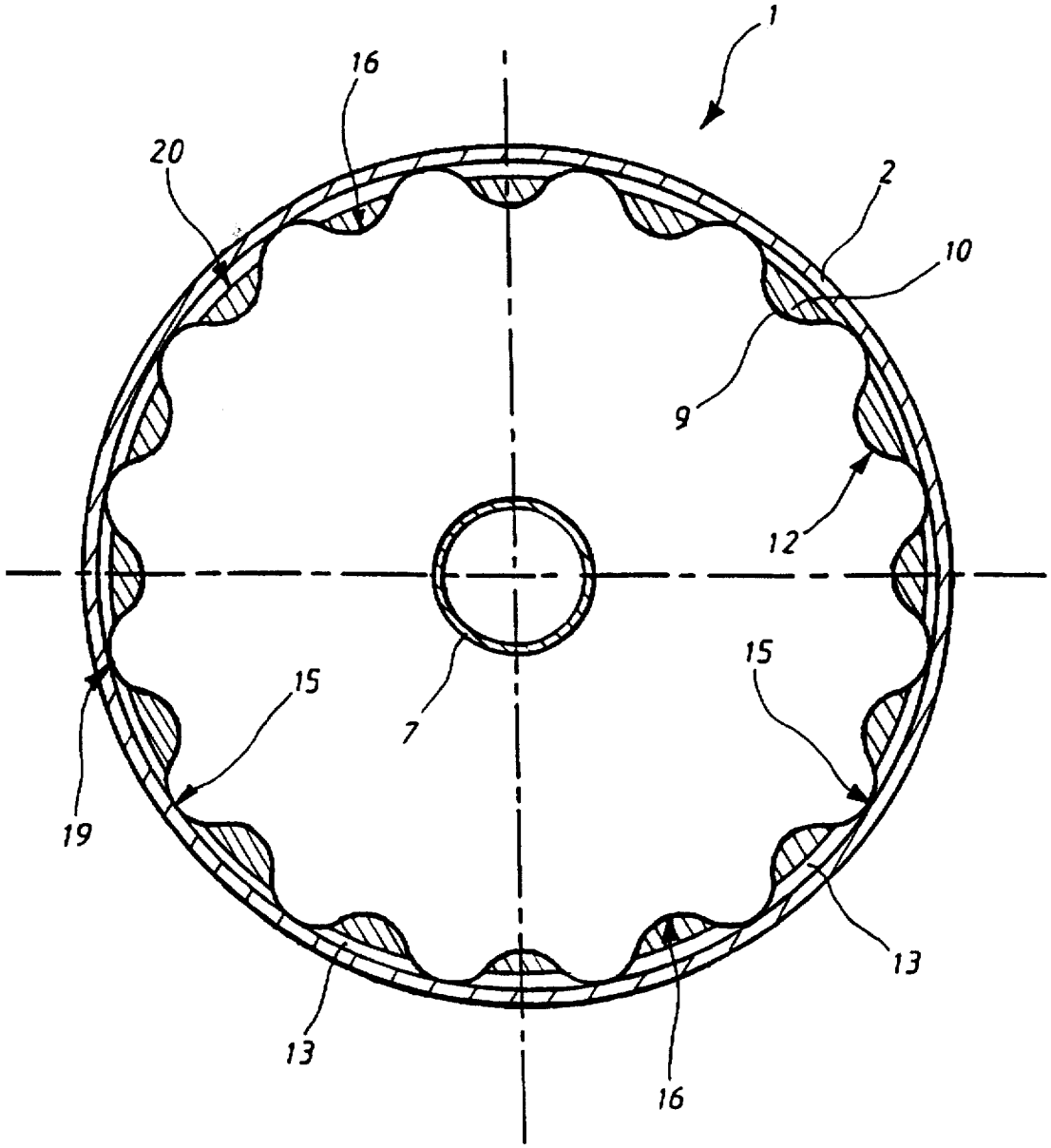

Other advantages of the invention will become apparent from reading the description which will follow of the various embodiments, a description made with reference to the appended drawings wherein:

FIG. 1 shows an axial section of a case according to a first embodiment of the invention, FIG. 2 is a cross-section along plane AA in FIG. 1, FIG. 3 shows an axial section of a case according to a second embodiment of the invention, FIG. 4 shows an axial section of a case according to an alternative of the second embodiment of the invention, FIG. 5 shows an axial section of a case according to a third embodiment of the invention, FIG. 6 shows a cross-section of a case according to a fourth embodiment of the invention, FIG. 7 is an axial section along plane BB in FIG. 6, FIG. 8 shows a cross-section of an alternative to the case according to the fourth embodiment of the invention.

With reference to FIG. 1, a modular element of an artillery propellant charge is a case 1 comprising a cylindrical tubular envelope 2 made of a combustible material, for example cardboard loaded with nitrocellulose and closed at each end by a lid 3 also made of a combustible material.

The two lids 3 are identical to one another and both have a base 4 integral with a cylindrical rim 5. They are made integral with the envelope 2 by bonding on their cylindrical rims 5.

Each lid has an axial cylindrical collar 6 on which a cylindrical duct 7 also made of a combustible material is fastened to each lid 3 by bonding on the collars 6.

The duct 7 is designed to accommodate an initiation device of a known type, not shown, formed, for example, of a stack of compressed black powder rings.

The case 1 is designed to accommodate a propellant charge 21 of a known type, for example, in the form of pre-fragmented bits 8. The propellant charge is set in place before bonding of the second lid.

Inside the propellant charge, the case 1 comprises a roughly cylindrical support 12 made of a combustible material and coated on its inner surface by an anti-wear additive 10. The support 12 is a sheet 9 made, for example, of cardboard loaded with nitrocellulose. The sheet is around 0.3 to 0.5 mm thick, which allows it to be coated with a layer of anti-wear additive and gives it sufficient rigidity to enable it to hold its shape inside the case without requiring it to be made integral with another component.

The anti-wear additive is made, in a known manner, by a mixture of wax and titanium dioxide, with a proportion of 50% for each component.

The cylindrical tubular shaped sheet 9 is positioned inside the propellant charge and at a distance from the envelope 2 of the case 1. The propellant charge acts as a radial limit stop for the sheet 9 and ensures that an empty space 13 is left between the envelope and the additive 10.

FIG. 2 shows a cross-section along plane AA in FIG. 1.

As shown, the anti-wear additive is put on the inner surface of the tubular sheet 9. It could just as well be put on the outer surface of the sheet.

Such a configuration enables the anti-wear additive to be kept at a distance from the wall thereby facilitating the total combustion of the wall 2 which is made of a combustible material, the anti-wear additive does not in this case cause a barrier to the combustive gases generated by the propellant charge. The additive itself is attacked by the propellant charge on two roughly opposite faces and is thus more evenly spread over the inner surface of the barrel of the weapon.

The anti-wear additive is put in place as follows:

the sheet 9 is rolled and bonded so as to make a cylindrical tubular support, then, the anti-wear additive 10 is sprayed on the inner face of the sheet to a thickness of around 1 to 2 mm.

After drying and hardening, the sheet-additive assembly is positioned in the module before the propellant charge and the second lid are set into place.

As an alternative, the reception section of the anti-wear additive may be limited to only one or several portions of the surface of the sheet, this enables one or several passages to be freed for the combustive gases to pass through the sheet.

The support may comprise one or several cylindrical sections held in place by the propellant charge.

The case according to the invention may also be a combustible shell for the propellant charge of a tank munition.

FIG. 3 shows a case according to a second embodiment of the invention.

The case 1 which is formed of the envelope 2 closed at the ends by two lids 3 comprises a support 12 also made of a sheet 9 in combustible material which accommodates an anti-wear additive 10. The sheet 9 is of a cylindrical tubular shape and is made like the above-described sheet.

In this second embodiment the anti-wear additive is held at a distance from the wall 2 by at least one radial limit stop which is formed by means of the cylindrical rims 5 of the lids 3 against which the support 12 rests. An empty space 13 is thus left between the envelope and the additive and enables the combustive gases of the propellant charge (for example, loose powder, not shown), after burning the lids, to attack the anti-wear additive 10 on two roughly opposite faces whilst ensuring the total combustion of the envelope 2.

The advantage of such an embodiment lies in that fact that the anti-wear additive is near the envelope of the case and thus is also near the inner surface of the barrel of the weapon, thereby ensuring that the additive is more evenly spread over this barrel surface.

FIG. 4 shows an alternative to this second embodiment of the invention. The envelope 2 of the case 1 comprises, on its inner face and roughly half-way between the two rims 5, a ring 23 made of a combustible material which is made integral with the envelope, for example, by bonding. The support 12 rests, by means of the sheet 9, on the ring 23 which also acts as a radial limit stop.

Such a configuration avoids the support 12 being flattened against the envelope 2 during the pressure build-up of the combustive gases of the propellant charge.

As an alternative, this radial limit stop may be made in the form of part of a ring. It is also possible to provide several rings and/or parts of rings integral with the sheet 9 or the envelope 2.

According to another alternative, the sheet 9 may be made of a brittle material breaking under the pressure build-up of the combustive gases. The breaking-up of the sheet will in turn cause that of the additive thereby creating of additional passages through which the combustive gases will pass in order to attack the envelope and additive. The sheet could, for example, be made in a combustible and breakable material of the nitrofilm type.

FIG. 5 shows a section of a third embodiment of a case according to the invention.

In this embodiment, the lids 3 have a cylindrical rim 5 of a length which is roughly half that of the length of the case 1 such that the rims of the two lids are more or less resting against one another.

The lids 3 have outward openings 14 on their rims 5, in this example there are 8 of them.

The openings 14 are partly filled by the anti-wear additive 10.

This partial filling is carried out as follows:

positioning of a wedge blocking the openings on the outer surface of a cylindrical wall of the support, the support being an extension of the lids formed by the rims 5, the wedge being made, for example, by a sheet of paper which is thinner than that of the support.

the anti-wear additive is poured into the openings.

the wedge is removed after the additive has dried out.

The duct 7 is then bonded to the lids 3, then the envelope 2 is slid into place over the lids. One or more apertures, not shown, will be made in the bases 4 of the lids 5 so as to be able to insert the propellant charge into the module. The apertures will be blocked up after filling by means of a suitable piece of paper or a cap.

As an alternative, a roughly cylindrical support fitted with openings may be positioned against the inner surface of the case between two lids having rims of a reduced width. The support could also be integral with one of the lids, the second lid having only a narrow rim.

The number and size of the openings may be varied and certain openings may remain with no anti-wear additive.

FIG. 6 shows a section of a fourth embodiment of a case according to the invention.

In this fourth embodiment, the support 12 corrugated sheet 9 made of a combustible material.

The sheet 9 accommodates the anti-wear additive 10 in the inner hollows 15 of its undulations, the outer surface 17 of the additive being more or less flush with the crest 18 of the undulations.

The outer hollows 16 of the undulations of the sheet 9 remain empty and provide several empty spaces 13 between the support and the envelope 2, spaces which are shaped like longitudinal vents.

The sheet 9 is, in this example, resting against the cylindrical rims 5 of the lids, as shown in FIG. 7 and the sheet is thus not resting against the inner surface of the case and the empty spaces 13 also have a tubular volume which corresponds to the thickness of the rims 5.

In this configuration, no part of the support comes into contact with the envelope 2, which further improves the passage of the combustive gases which, after having burned both the rims 5 of the lids and the inner crests 18 of the undulations which are not coated with additive, spread out in the tubular volume 22 and the vents 13. Thus, the combustive gases easily reach the envelope and the anti-wear additive is attacked on several different faces.

The support 12 of the anti-wear additive is made as follows:

the sheet 9 of nitrocellulose cardboard is corrugated according to conventional paper-making techniques, the anti-wear additive is poured into the hollows of the undulations until it is more or less flush with the crests of the undulations, after the additive has dried out, the support is rolled to give it a tubular shape and possibly bonded (the rolling phase is possible thanks to the undulations of the sheet and the absence of anti-wear additive on the inner crests 18 of the undulations).

As an alternative, the support may rest against the inner surface of the envelope 2 which allows the combustive gases to pass directly via the ducts 13.

According to another embodiment shown as a cross-section in FIG. 8, the sheet 9 accommodates the anti-wear additive 10 in the outer hollows 16 of its undulations. The sheet 9 is, in this example, in direct contact with the inner surface of the envelope 2 via the outer crests 19 of its undulations. The outer surface 20 of the anti-wear additive is retracted with respect to the outer crests 19 of the undulations thereby creating several empty spaces 13, in the shape of ducts, between the envelope 2 and the anti-wear additive.

The support 12 for the anti-wear additive is made as follows:

the anti-wear additive is poured into the hollows in the undulations of the sheet 9, after corrugation of the latter, leaving a clearance below the crests 19 of the undulations.

after the additive has dried out, the support is rolled and bonded before being inserted inside the module 1.

The hollows 15 which are not coated with additive, and thus which burn very quickly, and the empty spaces 13 enable the combustive gases of the propellant charge to pass quickly through to the envelope 2. The envelope will burn easily and the anti-wear additive will be attacked on several separate faces.

The cases of the various embodiments hereabove described may just as well be applied to combustible shells for a propellant charge of a tank munition or to combustible modules for a propellant charge of an artillery munition.

We claim:

1. A case in combination with a propellant charge, the propellant charge disposed within a substantially cylindrical envelope that is formed from a combustible material, comprising:

at least one support that is formed from a combustible material and coated on at least one reception section with an anti-wear additive; and means for positioning the support spaced from the substantially cylindrical envelope such that, after assembly, at least one empty space is defined between an inner surface of the envelope and the anti-wear additive, the means for positioning being formed from a combustible material;

said means for positioning comprising a radial stop defined by a plurality of sticks of propellant charge between said inner surface of said substantially cylindrical envelope and said at least one support.

2. A case in combination with a propellant charge according to claim 1, wherein the support is a sheet having a substantially cylindrical shape resting against said radial stop which ensures that at least one empty space is defined between the inner surface of the envelope and the anti-wear additive.

3. A case in combination with a propellant charge according to claim 2, wherein the radial stop further includes at least one lid having a cylindrical rim closing off the substantially cylindrical envelope of the case.

* * * * *